United States Patent [19]

Koski

[11] Patent Number: 4,565,155

[45] Date of Patent: Jan. 21, 1986

[54] SIZE PRESS

[75] Inventor: Erkki Koski, Jyväskylä, Finland

[73] Assignee: Valmet Oy, Finland

[21] Appl. No.: 504,040

[22] PCT Filed: Oct. 25, 1982

[86] PCT No.: PCT/FI82/00049

§ 371 Date: May 26, 1983

§ 102(e) Date: May 26, 1983

[87] PCT Pub. No.: WO83/01636

PCT Pub. Date: May 11, 1983

[30] Foreign Application Priority Data

Oct. 27, 1981 [FI] Finland ..... 813356

[51] Int. Cl.[4] ..... B05C 3/132

[52] U.S. Cl. ..... 118/412; 118/414

[58] Field of Search ..... 118/411, 412, 414, 407

[56] References Cited

U.S. PATENT DOCUMENTS

| | | | |
|---|---|---|---|
| 2,257,113 | 9/1941 | George | 91/43 |
| 4,108,110 | 8/1978 | Berry | 118/412 |
| 4,177,304 | 12/1979 | Berry | 427/434 R |
| 4,259,921 | 4/1981 | Wallsten | 118/414 X |
| 4,325,784 | 4/1982 | Dreher | 118/414 X |

*Primary Examiner*—John P. McIntosh

*Attorney, Agent, or Firm*—Steinberg & Raskin

[57] ABSTRACT

A size press, which comprises three coating rolls (11, 12, 13). These rolls (11, 12, 13) form two press nips ($N_1$, $N_2$) as pairs with each other, the paper web (W) to be treated being passed through the said press nips. Both sides of the web (W) are treated in the said nips ($N_1$, $N_2$). Out of the said coating rolls, regarding the position of altitude, the uppermost roll (12) has been arranged as the center roll of the size press, in connection with which center roll the two coating nips ($N_1$, $N_2$) are formed so that the first coating nip ($N_1$) is placed at a short angular distance ($\alpha_1$) underneath the horizontal plane (H—H) placed through the axis of the said center roll (12). The second coating nip ($N_2$) is formed by the third coating roll (13), which is placed substantially in the vertical plane (V—V) placed through the center point of the center roll (12) or at a small angle ($\alpha_2$) after the said plane. As preceding the first nip ($N_1$), size-feed devices (24, 25) have been provided at the center-roll (12) side of the run of the web (W), which size-feed devices (24, 25) feed a first size pool ($L_1$) or layer into the substantially vertical pit between the center roll (12) and the web (W). Preceding the second nip ($N_2$), a second set of size-feed devices (26, 27) has been provided in the substantially horizontal pit formed by the center roll (12) and by the third coating roll (13), the said second size-feed devices (26, 27) forming the second size pool ($L_2$) or layer at the opposite side of the web (W), as compared with the said first size pool ($L_1$) or layer. The said devices are jointly operative so that, while the sizing is performed, the web (W) is supported by a roll face.

11 Claims, 4 Drawing Figures

SIZE PRESS

The present invention is concerned with a size press, which comprises three coating rolls, which form two press nips as pairs with each other, the paper web to be treated being passed through the said press nips so that both sides of the web are treated in the said nips.

Most of the production of fine papers is surface-sized or coated. Surface-sizing is a relatively simple and inexpensive quality-improvement method of paper. The surface-sizing is usually performed in an on-machine size press placed in the paper machine. Surface-sizing of fine-paper qualities that contain mechanical pulp is becoming more common especially for offset printing purposes. Besides these, kraft liners, boards, and various base papers are surface-sized or precoated in a size press. The fields of application of size presses mentioned above can be divided into four groups.

(1) Surface-sizing of writing and printing papers
(2) Surface-sizing and precoating of base papers
(3) Pigmenting or coating of paper
(4) Production of special sorts In a way known from prior art, the paper web is run through a roll nip of a size press. The size is fed in the press onto the paper by forming a pool in front of the nip, in which pool the web becomes wet and adsorbs size. Between the rolls of the size press, size is pressed into the paper web owing to the hydrodynamic pressure. At the same time, owing to the hydrodynamic pressure, a size film is formed between the paper and the roll, which film is split at the outlet of the roll and allows a film of size to remain on the paper. The quantity of size remaining on the paper depends on the viscosity of the size, on the machine speed, on the diameter of the roll, on the surface properties of the roll, on the line pressure, as well as on factors attributable to deformation of the roll.

The oldest one among the prior-art size presses is the so-called vertical size press, wherein the rolls are placed one above the other and the paper passes horizontally between the rolls. In the prior-art horizontal press, the rolls are placed on the same horizontal level and the paper passes vertically between the rolls. A third prior-art size press is the so-called diagonal press, wherein the rolls are placed one above the other at an angle of about 45°. This is the best prior-art solution in view of the passing of the web at high running speeds.

The roll diameters of the size press are important from the point of view of the running properties. For the nip rolls of prior-art size presses, diameters of the order of 800 to 1500 mm have been chosen at running speeds of 10 to 17 m/s. As is well known, by increasing the roll diameter when the speed is increased, attempts are made to prevent splashing in the pool gap, because such splashing disturbs uniform moistening of the paper web.

Mostly rubber has been used as the covering material of the rolls in the size press. Presses are also known in which the hard roll is of metal and the soft roll of rubber. Thus, softer and harder pressing zones are used. At higher speeds, rolls of a larger diameter are used than at lower speeds.

Besides a sufficient wetting time, good penetration of the size into the surface also requires high compression, 20 to 50 kN/m.

In respect of the prior-art technology related to the present invention, reference is made to the Finnish Pat.

No. 28,686 (Class 55 f 15/20, published on Mar. 15, 1957, Combined Locks Paper Co, U.S.A.). From this Finnish patent, such a paper coating machine is known in prior art as comprises a hard centre roll and, in connection with it, two nips through which the paper web to be coated is passed. The size or any other coating agent is first brought from a trough via several applicator rolls onto the said hard-faced roll, from which it is pressed onto the web in the first nip. The other side of the web is coated by, from the trough, bringing the coating agent via several applicator rolls onto the latter nip roll, from which it is pressed onto the other face of the web in the latter nip formed in connection with the hard centre roll. According to the said Finnish patent, the nip rolls form nips with the lower hard centre roll so that these nips are placed in connection with the centre roll substantially symmetrically in relation to the vertical plane passing through the axis of the centre roll and at a central angle of the centre roll equalling about 45° relative the said vertical plane.

According to the said Finnish patent, the coating material is supplied by means of small-radius applicator rolls, whereas the present invention is concerned with size presses in which the size or any other coating agent is supplied through nozzles so as to form a pool placed between the paper web and the roll.

The production of fine paper is about to be shifted to large paper machines, which imposes high requirements on the size presses. A size press of deficient operation reduces the productivity of the whole paper machine. Thus, the present invention will suggest certain solutions which have been developed especially in view of high running speeds.

A general objective of the present invention is to provide such a size press as is suitable for use at higher web speeds than in prior art. Since the size press subject of the present invention is an on-machine apparatus to be connected to the end of a paper machine, this apparatus must be capable of running at equally high web speeds as the paper machine is. In practice, it has often been the size press that has formed a bottleneck limiting the speed of the paper machine. It is another objective of the present invention to eliminate this drawback as well.

It is a further objective of the invention to provide a size press in which the overall geometry of the rolls is as favourable as possible in view of the passing of the web.

In respect of the prior-art technology related to the invention, reference is made to the Finnish Patent Application No. 803,710 (filed on Nov. 28, 1980, applicants Valmet Oy and Kymi Kymmene Oy). In the said patent application, a size press is described which comprises three coating rolls, which form two press nips as pairs with each other, the paper web to be treated being passed through the said press nips so that both sides of the web are treated in the said nips.

In the size press in accordance with the above application, it has been considered a novelty that the middle one out of the said coating rolls, as considered regarding its position of altitude, has been arranged as the centre roll of the size press, in connection with which the two coating nips are formed so that the first coating nip is placed at an appropriate angular distance above the horizontal plane placed through the axis of the said centre roll, that the second coating nip is formed by the third coating roll, which is placed at an appropriate angular distance of the centre roll, downwards from the said horizontal plane, and that, as preceding the first nip, size feed devices have been provided at the centre-roll side of the running of the web, the said size feed devices feeding a first size pool or layer into the pit between the centre roll and the web, as well as, preceding the second nip, a second set of size feed devices has been provided in the gap formed by the centre roll and the third coating roll, the said devices forming a second size pool or layer at the opposite side of the web, as compared with the first size pool or layer, whereat the said devices are arranged as jointly operative so that, while the web runs from its main direction downwards, it is supported by a roll face during the sizing operation.

Another objective of the present invention is further development of the size press described in the said Finnish application with the purpose of above all achieving an easy running of the web that is as straight as possible. A particular objective is to provide such a size press in which the moistened web does not have to run on the bottom of a pool, at least not as loaded by the pool when unsupported.

Moreover, in respect of the prior art technology, reference is made to the U.S. Pat. No. 4,108,110. The objective of the present invention, as compared with the prior-art technology disclosed in the said U.S. patent is to provide a size press in which the run of the web is less curved, which involves a clear advantage especially in view of the transfer of the end of the web.

Another objective of the present invention is to permit the release of the web almost immediately after the second pool.

An additional objective of the invention is to make it possible to transfer the web from the size press either to the lower cylinder or to the upper cylinder of the following drying section.

Even though size presses have been discussed above, it is to be understood that in this connection the notion "size" has been used in a wide sense as also including any other agents, in themselves known, that are used for the treatment of paper or board web and that are suitable for use in apparatuses of the type concerned.

In order to achieve the goals stated above and those to come out below, the invention is mainly characterized in that, out of the said coating rolls, regarding the position of altitude, the uppermost roll has been arranged as the centre roll of the size press, in connection with which centre roll the two coating nips are formed so that the first coating nip is placed at a short angular distance underneath the horizontal plane placed through the axis of the said centre roll, that the second coating nip is formed by the third coating roll, which is placed substantially in the vertical plane placed through the centre point of the centre roll, or at a small angle after the said plane, and that, as preceding the first nip, size-feed devices have been provided at the centre-roll side of the run of the web, which size-feed devices feed a first size pool or layer into the substantially vertical pit between the centre roll and the web, as well as that, preceding the second nip, a second set of size-feed devices has been provided in the substantially horizontal pit formed by the centre roll and by the third coating roll, the said second size-feed devices forming the second size pool or layer at the opposite side of the web, as compared with the said first size pool or layer, the said devices being arranged as jointly operative so that, while the sizing is performed, the web is supported by a roll face.

In the three-roll size press in accordance with the invention, the first nip is, in a way, inclined towards the wet end of the paper machine, as compared with the vertical plane, and the second nip is almost in the vertical plane, like in the prior-art vertical size presses. Unlike the two-sided vertical press, the weight of the size does not strain the web within the area of the latter pool, where the web is wet and, therefore, rather weak, because the web runs at the proximity of the upper surface of the size pool.

Figure 1:
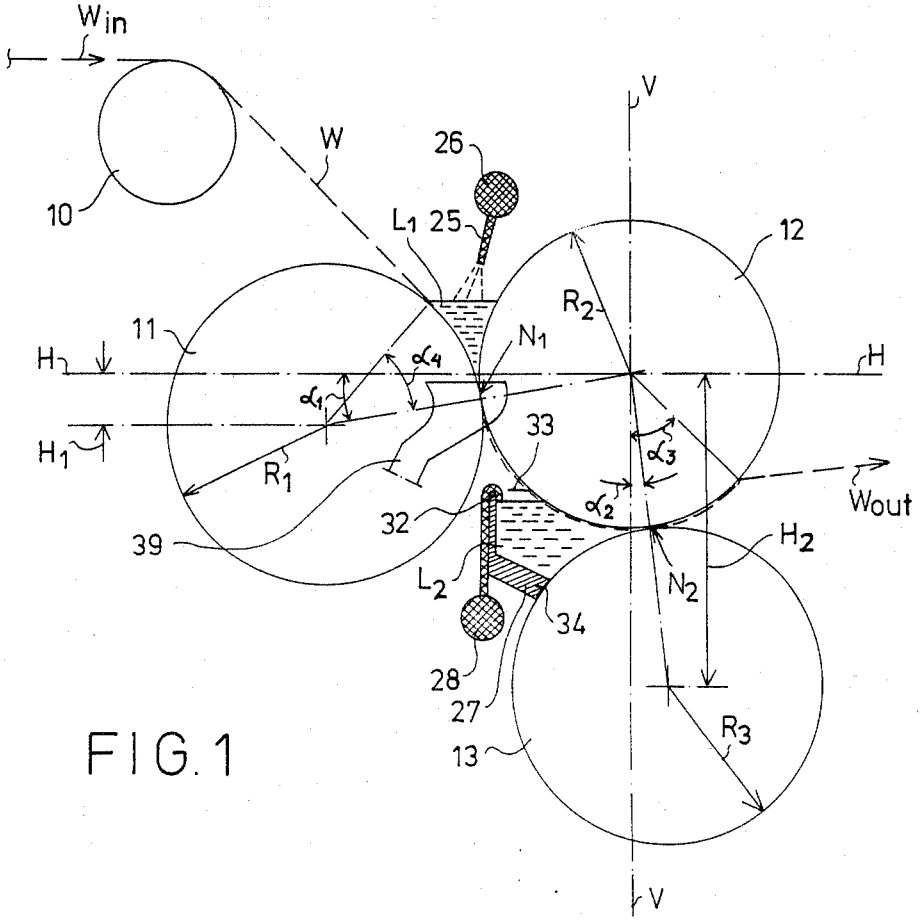
FIG. 1 is a schematical presentation of the roll geometry, of the running of the web in the size press, and of the positioning of the size pools.

The size press shown in the FIGURES comprises a frame portion 30, in connection with which the rolls 10,11,12,13 of the size press are journalled and the other apparatuses belonging to the size press are fitted. The inlet of the web W to be treated and coming from the paper machine, into the size press is denoted with reference $W_{in}$.

The outlet of the web W treated on both sides with a coating agent, such as size, from the size press is denoted with reference $W_{out}$. The running of the web W to be coated through the size press is denoted with broken line. The foundation on which the size press has been placed is denoted with reference numeral 40. Protective sheets that prevent splashing of the size are denoted with reference numeral 31.

Out of the rolls of the size press, in the direction of running of the web W, the first one is a guide roll 10, which is journalled to the frame 38, which is arranged as movable in the direction of the arrows F along guides 39. The first coating roll 11 is journalled on supports 17, which have been fixed in connection with the frame 30 by means of a horizontal articulated shaft 21. The frame 17 can be pivoted by means of a diaphragm actuator 22, by means of which the line pressure of the first coating nip $N_1$ can also be adjusted.

The first coating nip $N_1$ is formed in connection with the coating rolls 11 and 12. The roll 12 is the centre roll of the press, which is mounted to stationary bearing supports 15. The centre roll 12 forms the second coating nip $N_2$ with the third, lowest coating roll 13. The third coating roll 13 is mounted to bearing supports 19, which are fixed to frame constructions 23. The latter frame constructions 23 are connected to the frame 30 by means of horizontal articulated shafts 24 so as to be pivoted by means of a diaphragm actuator 25, e.g., for adjusting the nip pressure of the second coating nip $N_2$.

In the apparatus, two pools $L_1$ and $L_2$ of coating agent are formed. The feeder devices for coating agent placed in connection with the first pool $L_1$ comprise a size-feeder pipe 26 extending across the entire width of the web W and provided with several nozzle pipes 25 placed side by side or with a corresponding unified slot nozzle. The first size pool $L_1$ is formed in the gap defined by the centre roll 12 and by the web W before the first nip $N_1$. From the pool $L_1$ the size or any other, corresponding coating agent is adsorbed onto one side of the web W, and the size agent is pressed in the nip $N_1$ into the web W.

The apparatus includes a second size-feeder pipe 28, fitted close to the third coating roll 13 substantially at the level of the nip $N_2$, in connection with which pipe 28 there is a series of size-feeder nozzles 32 or a corresponding nozzle slot. The nozzles 32 supply size jets into a particular trough 27 of the second size pool $L_2$, placed before the nip $N_2$. In this way, the second size pool $L_2$ is formed before the nip $N_2$, and from this pool $L_2$ the other side of the web W is treated and impregnated. After the nip $N_2$, the web W follows, e.g., the roll 12 within the sector $\alpha_3$, after which the web W is passed via guide rolls or equivalent to the following treatment steps, in themselves known, in this particular case to the upper cylinder of the drying section (not shown). The sector $\alpha_3$ may be smaller or larger than that shown in the figure, however, so that the running of the web W is also smooth after the size press.

In accordance with the figure, the web W contacts the first coating roll 11 at an appropriate angle $\alpha_4$ before the nip $N_1$, which is also important in the respect that thereby attempts are made to prevent access of air into the nip $N_1$. The magnitude of the angle $\alpha_4$ is most appropriately about 20° to 40°.

Figure 3:
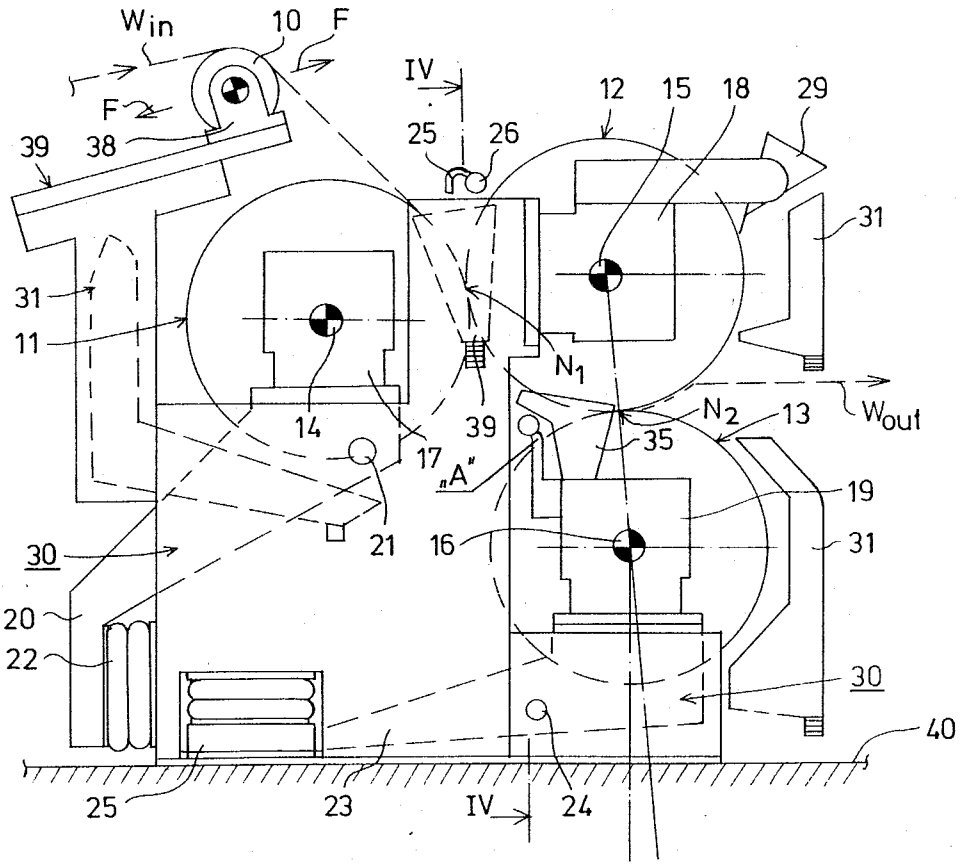
FIG. 3 shows the size press in accordance with the invention, together with the frame construction, as a side view.

On the free sectors of the coating rolls 11,12,13, devices in themselves known are provided that keep the faces of the rolls clean of the coating agent, only the doctor 29 of the roll 12 in FIG. 3 being shown out of these devices.

One of the essential features of the invention is the relative positioning of the rolls 11, 12 and 13 in relation to each other for the formation of the nips $N_1$ and $N_2$ as well as the size pools $L_1$,$L_2$ preceding the nips $N_1$,$N_2$ and their positioning in relation to the rolls 11, 12 and 13 and to the running of the web W. As is shown in FIGS. 1 and 3, the centre roll 12 of the size press is the uppermost roll of the press so that the first nip $N_1$ between the peripheral roll 11 and the centre roll 12 is formed underneath the horizontal plane H-H placed through the centre point of the centre roll 12 (distance $H_1$) at the central angle $\alpha_1$ of the roll 12. The angle $\alpha_1$ is a relatively small angle, whose magnitude is preferably 5° to 20°, usually most appropriately about 10°. In any case, the angle $\alpha_1$ is smaller than about 45°. The other peripheral roll 13 is placed underneath the centre roll 12, most appropriately after the vertical plane V—V placed through the centre point of the roll 12, at a small central angle $\alpha_2$. The magnitude of the angle $\alpha_2$ is, e.g., 5° to 10°. Thus, the centre roll 12 is the uppermost roll among the said rolls, being placed by the distance $H_1$ higher than the first peripheral roll 11, onto which the web W is brought. Since the angle $\alpha_2$ is small, the vertical distance between the centre points of the rolls 12 and 13 is $H_2 \approx R_2 + R_3$.

The above-noted object of the invention to provide the run of the web through the size press less curved than in conventional size presses of the type disclosed in U.S. Pat. No. 4,108,110 is achieved by the apparatus described above. As clearly seen in the drawings, the web W has a horizontal component of velocity in only one horizontal direction (left-to-right in the drawings) at all times as it passes through the size press.

Thus, the roll geometry of the size press is such that the uppermost roll 12 is the centre roll and the peripheral rolls 11 and 13 are positioned so that the first nip $N_1$ is formed slightly underneath the horizontal plane H—H (angle $\alpha_1$ and dimension $H_1$ in FIG. 1) and the second nip $N_2$ is formed substantially in the vertical plane V—V or slightly after that plane (angle $\alpha_2$)

This size press is also advantageous in the respect that a normal prior-art single-nip vertical press can be advantageously converted to a size press in accordance with the present invention by providing it with another peripheral roll 11 and with size-feed devices 25,26 related to the first size pool $L_1$.

Figure 2:
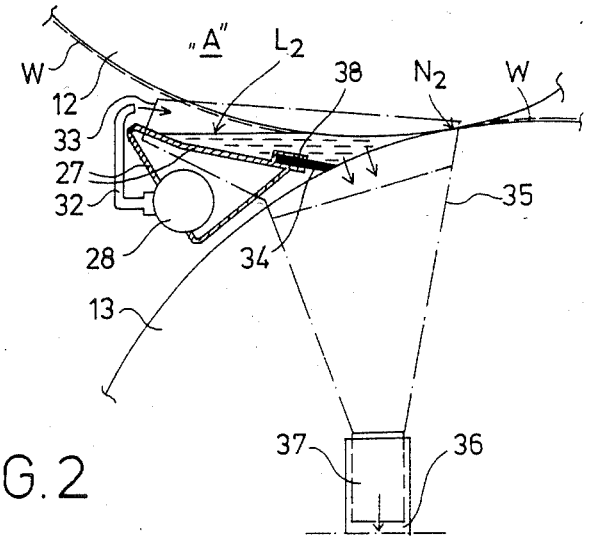
FIG. 2 shows a detail "A" in FIG. 3.

Moreover, as regards further details of the size-feeder devices and size pools $L_1$, $L_2$, in respect of the size pool $L_2$, reference is made in particular to FIG. 2, according to which the size pool is defined by a box beam 27. In connection with the beam 27, there are the size-supply pipe 28 and the nozzle pipes 32, which feed size into the pool. The slot between the beam 27 and the roll 13 is sealed by means of an elastic fillet 34, whose inner edge rubs against the roll 13. The sealing fillet 34 is fixed to the beam 27 by means of a holder 38. The size pool $L_2$ is defined laterally by walls 33, underneath of which there are troughs 35. At the lower end of the troughs 35 there is a conduit 37, through which any excess size can flow into exhaust pipes 36. Corresponding troughs 39 are provided at the sides of the first size pool $L_1$ and of the first nip $N_1$.

Figure 4:
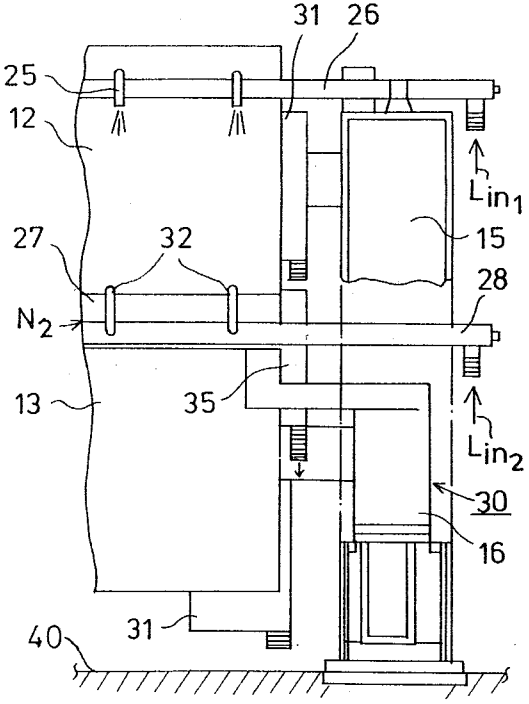
FIG. 4 shows a section at IV—IV in FIG. 3.

In FIG. 4, the feeding of size into the feed pipe 26 above the first pool $L_1$ is denoted with the arrow $L_{in1}$ and the feeding of size into the size-feed pipe 28 in connection with the second pool $L_2$ with the arrow $L_{in2}$.

Out of experience, it is known that, in a size press nip it is advantageous to have a hard roll and a soft roll against each other, because in a nip between two hard rolls, holes tend to be formed in the paper. In a preferred embodiment of the invention, the hardest roll is the centre roll 12, e.g., a "Microrok" coated roll, whose hardness is within the range of 0 to 1 P&J degrees of hardness. With this roll 12, the first press nip $N_1$ is formed by a softer "Micromate" coated roll, whose surface hardness is, e.g., within the range of 20 to 30 P&J degrees. The second press nip $N_2$ with the centre roll 12 is formed by the second peripheral roll 13, whose surface is similar to that of the roll 11.

In the roll arrangement described above, the initial requirement, to the effect that a hard roll and a soft roll form the nips, is met in such a way that the centre roll 12 is the hardest roll and two softer rolls 11 and 13 are pressed against the centre roll.

The moisture content of the paper web W entering into the size press is 3 to 8%. At a moisture lower than this, the paper is brittle and its capacity of absorption is poor. At a moisture higher than this, the humidity is heterogeneous and the capacity of absorption of the paper is excessively high. The line loading at the nips $N_1$ and $N_2$ is 10 to 50 kN/m, preferably about 30 to 40 kN/m. At least two of the rolls 11,12,13 must be variable-crown rolls especially in size presses by means of which papers of different types are run. Variable crown is more necessary in wide machines than in narrow machines. The diameters $2R_1$, $2R_2$ and $2R_3$ of the rolls 11,12,13 are most appropriately selected as equal, as compared with one another, so as to facilitate the maintenance work, for example. In each nip $N_1$ and $N_2$, one of the rolls must also be soft out of the reason that the pressing zone in the nips $N_1$ and $N_2$ should be sufficiently wide. Each of the rolls 11, 12 and 13 has an adjustable drive 14, 15 and 16 of its own. The circumferential speeds of the rolls are equal to the speed of the web.

In accordance with the above, the first size pool $L_1$ is substantially a vertical pool, being formed in the substantially vertical pit between the rolls 11 and 12. The web W coming to treatment within the area of the pool $L_1$ is supported by the surface of the first peripheral roll 11. The second size pool $L_2$ is a side pool, which precedes the second nip $N_2$ placed substantially in the vertical plane V—V. The pool $L_2$ must be sealed by means of a fillet 34 or equivalent in relation to the second peripheral roll 13. Within the area of the second pool $L_2$, the web W is supported by the surface of the centre roll 12 while the web passes via the surface part of the second pool $L_2$.

Below, the patent claims will be given, whereat the various details of the invention may show variation within the scope of the inventive idea defined by the said claims.

What is claimed is:

1. A size press, which comprises three coating rolls (11, 12, 13), which form two press nips ($N_1$, $N_2$) as pairs with each other, the paper web (W) to be treated being passed through the said press nips so that both sides of the web (W) are treated in the said nips ($N_1$, $N_2$), characterized in that the vertically uppermost roll (12) of the size press constitudes the centre roll of the size press, in connection with which centre roll the two coating nips ($N_1$, $N_2$) are formed so that the first coating nip ($N_1$) is placed at a short angular distance ($\alpha_1$) underneath the horizontal plane (H—H) placed through the axis of the said centre roll (12), that the second coating nip ($N_2$) is formed by the third coating roll (13), which is placed substantially in the vertical plane (V—V) placed through the centre point of the centre roll (12), or at a small angle $\alpha_2$) after the said plane, and that, as preceding the first nip ($N_1$), size-feed devices 25, 26 have been provided at the centre-roll (12) side of the run of the web (W), which size-feed device 25, 26 feed a first size pool ($L_1$) or layer into the substantially vertical pit between the centre roll (12) and the web (W), as well as that, preceding the second nip ($N_2$), a second set of size-feed device 27, 28) has been provided in the substantially horizontal pit formed by the centre roll (12) and by the third coating roll (13), the said second size-feed devices (27, 28) forming the second size pool ($L_2$) or layer at the opposite side of the web (W), as compared with the said first size pool ($L_1$) or layer, the said devices being arranged as jointly operative so that, while the sizing is performed, the web (W) is supported by a roll face.

2. A size press as claimed in claim 1 characterized in that the first peripheral roll (11) is placed underneath the horizontal plane (H—H) placed through the centre point of the centre roll (12) at a small central angle ($\alpha_1$) of the centre roll (12), the magnitude of the said angle ($\alpha_1$) being within the range of 5° to 20°, preferably about 10°.

3. A size press as claimed in claim 1, characterized in that the second peripheral roll (13) is placed after the vertical plane (V—V) placed through the centre point of the centre roll (12) at a small central angle ($\alpha_2$) of the centre roll (12), the magnitude of the said angle being about 5° to 10°.

4. A size press as claimed in claim 1 characterized in that the web (W) is passed out of the size press ($W_{out}$) substantially horizontally, slanting upwards or downwards if necessary.

5. A size press as claimed in claim 5, characterized in that, after the second nip ($N_2$), the web (W) follows the centre roll (12) in a small angle ($\alpha_3$), whereupon the web (w) is passed as upwardly slanting, e.g., to the upper cylinder of the drying section.

6. A size press as claimed in claim 1 characterized in that, within the area of the first pool ($L_1$) the web (W), is supported by the first peripheral roll (11) at its central angle ($\alpha_4$), whose magnitude is preferably about 20° to 40°.

7. A size press as claimed in claim 1 characterized in that the second size pool ($L_2$), preceding the second nip ($N_2$), through whose upper part the web (W) to be treated passes as supported by the surface of the centre roll (12), is limited by a size trough (27), which, together with the substantially horizontal pit formed by the rolls (12, 13), defines the space of the second size pool ($L_2$), and that the said trough (27) is sealed by means of a fillet (34) or fillets in relation to the surface of the peripheral roll (13).

8. A size press as claimed in claim 7, characterized in that the trough provided for the second pool ($L_2$) is formed by a box beam (27), to whose edge facing towards the second nip ($N_2$) an elastic sealing fillet (34) is fixed by means of a holder (38) or equivalent, and that a size-feed pipe (28) is fixed in connection with the said box beam (27), from which pipe (28) several nozzle pipes (32) or corresponding slot nozzles or nozzle start, feeding size into the second size pool ($L_2$).

9. A size press as claimed in claim 1 characterized in that the size pools ($L_1$, $L_2$) are laterally defined by walls (33), which are in connection with side troughs (35; 39), through which any excess size can be fed into exhaust piper (36).

10. A size press as claimed in claim 1, characterized in that the diameters ($2R_1$, $2R_2$, $2R_3$) of the three rolls (11, 12, 13,) of the size-press are substantially equal, as compared with each other.

11. A size press as claimed in claim 1, characterized in that the surface of the centre roll (12) is hard and smooth and that the surfaces of the peripheral rolls (11 and 13) are softer.

* * * * *